US009561896B2

(12) United States Patent
Hu et al.

(10) Patent No.: US 9,561,896 B2
(45) Date of Patent: Feb. 7, 2017

(54) PACKAGING APPARATUS

(71) Applicant: SHENZHEN CHINA STAR OPTOELECTRONICS TECHNOLOGY CO., LTD., Shenzhen, Guangdong (CN)

(72) Inventors: Qianshuang Hu, Guangdong (CN); Shih Hsiang Chen, Guangdong (CN); Chengwen Que, Guangdong (CN); Yi Cheng Kuo, Guangdong (CN)

(73) Assignee: SHENZEHN CHINA STAR OPTOELECTRONICS TECHNOLOGY CO., LTD, Shenzhen (CN)

( * ) Notice: Subject to any disclaimer, the term of this patent is extended or adjusted under 35 U.S.C. 154(b) by 0 days.

(21) Appl. No.: 13/983,631

(22) PCT Filed: Jun. 29, 2013

(86) PCT No.: PCT/CN2013/078513

§ 371 (c)(1),
(2) Date: Aug. 5, 2013

(87) PCT Pub. No.: WO2014/180062

PCT Pub. Date: Nov. 13, 2014

(65) Prior Publication Data

US 2016/0046433 A1 Feb. 18, 2016

(30) Foreign Application Priority Data

May 6, 2013 (CN) ..... 2013 1 0163370

(51) Int. Cl.

*B65D 85/48* (2006.01)
*B65D 85/38* (2006.01)
*B65D 81/05* (2006.01)
*B65D 21/02* (2006.01)
*B65D 25/10* (2006.01)

(52) U.S. Cl.

CPC ..... *B65D 85/38* (2013.01); *B65D 21/0205* (2013.01); *B65D 81/051* (2013.01); *B65D 81/055* (2013.01); *B65D 85/48* (2013.01); *B65D 21/0201* (2013.01); *B65D 21/0208* (2013.01); *B65D 25/107* (2013.01)

(58) Field of Classification Search

CPC ..... B65D 85/38; B65D 85/48; B65D 21/0205; B65D 21/0201; B65D 21/0208; B65D 81/051; B65D 81/055

USPC ..... 206/449, 454, 455, 515, 518, 1.5, 206/485–489; 118/500; 211/41.18; 220/4.21, 4.24, 4.33, 4.34

See application file for complete search history.

(56) References Cited

U.S. PATENT DOCUMENTS 5,072,835 A * 12/1991 Price, Jr. ..... G11B 23/0236 206/387.15
5,201,414 A * 4/1993 Kaszubinski ..... G11B 33/0472 206/308.1
5,379,899 A * 1/1995 Thurell ..... A61J 1/03 206/1.5

(Continued)

*Primary Examiner* — Luan K Bui

(57) ABSTRACT

The present invention discloses a packaging apparatus, comprising multiple packaging elements, each packaging element comprises a slot for receiving a LCD module, and the packaging apparatus further comprises a connecting means for integrating the multiple packaging elements side by side. Therefore, the packaging apparatus can be used for both LCD modules and end-products such as TV, display devices, the packaging cost can be reduced.

6 Claims, 5 Drawing Sheets

(56) References Cited

U.S. PATENT DOCUMENTS

| | | | | |
|---|---|---|---|---|
| 5,464,091 | A * | 11/1995 | Callahan | G11B 33/0438 206/485 |
| 7,374,044 | B2 * | 5/2008 | Ting | B65D 5/5085 206/454 |
| 8,251,220 | B2 * | 8/2012 | Ting | B65D 5/5088 206/454 |
| 8,777,008 | B2 * | 7/2014 | Hu | B65D 25/103 206/454 |
| 2001/0042726 | A1 * | 11/2001 | Chiu | H01L 21/67326 211/41.18 |

* cited by examiner

PACKAGING APPARATUS

FIELD OF THE INVENTION

The present invention is directed to the field of liquid crystal displays, and more particularly the present invention relates to a packaging apparatus, which can be used for both LCD modules and end-products such as TV, display devices.

BACKGROUND OF THE INVENTION

As the end-products of LCD (liquid crystal display) modules, such as TV, PC, Monitors, display devices, are widely used. The LCD modules used for such end-products are getting more and more thin and light in weight. Therefore, the packaging apparatuses become vital for protecting the LCD modules. Hence, the manufacturers pay much attention to the packaging apparatus for the LCD modules and end-products. Typically, after the LCD modules are delivered from the manufacturers of LCD modules to the manufacturers of end-products, shells, brackets, PCBs are assembled with the LCD modules, and then the end-products will be packaged and sent to sell out. In this process, the packaging apparatuses (such as buffering structure and packaging box) of the LCD modules are either abandoned or recycled. If the packaging apparatuses of the LCD modules are directly abandoned, it is a waste of packaging materials. If the packaging apparatuses of the LCD modules are recycled, money and manpower will be required to deliver the packaging apparatuses back to the manufacturers of LCD modules.

SUMMARY OF THE INVENTION

The present invention provides a packaging apparatus to solve the mentioned problem above.

The present invention is realized in such a way that: a packaging apparatus for LCD modules, comprising multiple packaging elements, wherein each packaging element comprises a slot for receiving a LCD module, the packaging apparatus for LCD modules further comprises a connecting means for integrating the multiple packaging elements side by side.

According to an embodiment disclosed herein, the connecting means comprises at least one connecting plate; each packaging element is provided with at least one groove engaging with said at least one connecting plate.

According to another embodiment disclosed herein, the connecting means comprises two connecting plates; each packaging element is provided with two grooves, said two connecting plates are inserted in said two grooves respectively.

According to another embodiment disclosed herein, said at least one groove is provided at the bottom of each packaging element.

According to another embodiment disclosed herein, said at least one connecting plate is provided with multiple protrusions, said at least one groove is provided with multiple recesses engaging with said multiple protrusions.

According to another embodiment disclosed herein, the packaging apparatus for LCD modules comprises four packaging elements.

According to another embodiment disclosed herein, said at least one connecting plate is corrugated cardboard.

According to another embodiment disclosed herein, said at least one connecting plate is PP plastic hollow board.

According to another embodiment disclosed herein, the multiple packaging elements are buffering blocks made of foamed plastic.

According to another embodiment disclosed herein, the multiple packaging elements are buffering blocks made of EPE foam.

According to another embodiment disclosed herein, the connecting means comprises adhesive components provided at the side of each packaging element, the multiple packaging elements are connected together side by side by the adhesive components.

According to another embodiment disclosed herein, the adhesive components are hook-and-loop fastening tapes.

According to another embodiment disclosed herein, the packaging apparatus for LCD modules comprises four packaging elements.

According to another embodiment disclosed herein, the multiple packaging elements are buffering blocks made of foamed plastic.

According to yet another embodiment disclosed herein, the multiple packaging elements are buffering blocks made of EPE foam.

According to the present invention, in present invention, each packaging element comprises a slot for receiving a LCD module, and the packaging apparatus further comprises a connecting means for integrating the multiple packaging elements side by side. Therefore, the packaging apparatus can be used for both LCD modules and end-products such as TV, display devices, the packaging cost can be reduced. To be specific, the manufacturers of LCD modules can combined multiple packaging elements that connected by the connecting means as a whole side by side to package multiple LCD modules at the same time in one packaging box. And the manufacturers of end-products can disconnect the combined multiple packaging elements and package end-products using separate packaging element in a one-to-one mode.

For more clearly and easily understanding above content of the present invention, the following text will take a preferred embodiment of the present invention with reference to the accompanying drawings for detail description as follows.

BRIEF DESCRIPTION OF THE DRAWINGS

The drawings described herein are for illustration purposes only and are not intended to limit the scope of the present disclosure in any way.

DETAILED DESCRIPTION OF PREFERRED EMBODIMENTS

The following detailed description of every embodiment with reference to the accompanying drawings is used to exemplify a specific embodiment, which may be carried out in the present invention. Directional terms mentioned in the present invention, such as "top", "bottom", "front", "rear", "left", "right", "up", "down", "inside", "outside", "side" etc., are only used with reference to the orientation of the accompanying drawings. Therefore, the used directional terms are intended to illustrate, but not to limit, the present invention. Also the following description is merely exemplary in nature and is not intended to limit the present disclosure, application, or uses. Besides, the term "integrate" and "combine" used herein means to bring together or incorporate parts into a whole in such a way that the whole are detachable.

Figure 1:
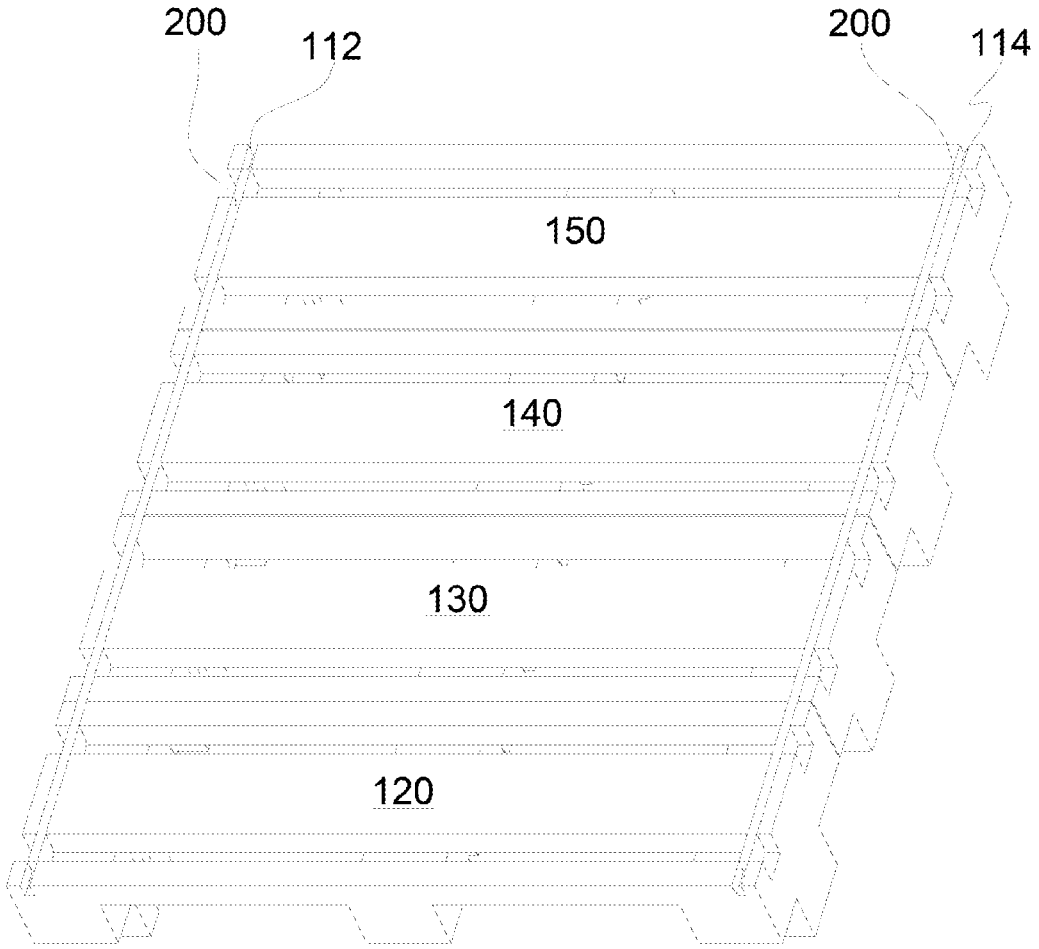
FIG. 1 is a schematic perspective view of the packaging apparatus according to the first embodiment of the present invention, which shows that four packaging elements are combined together side by side by two connecting means (two connecting plates) as a detachable whole.
Figure 2:
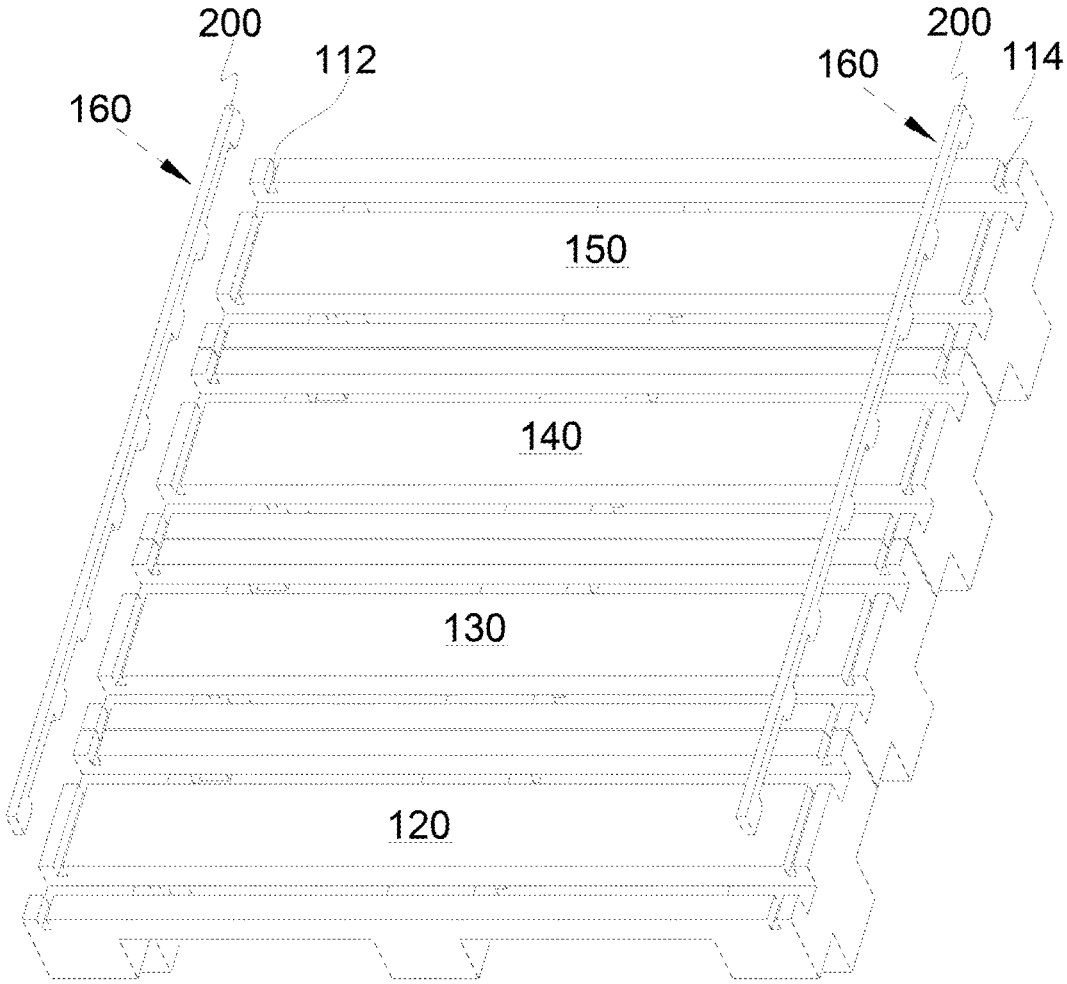
FIG. 2 is another schematic perspective view of the packaging apparatus in FIG. 1, which shows that four packaging elements are separated from two connecting means (two connecting plates)
Figure 3:
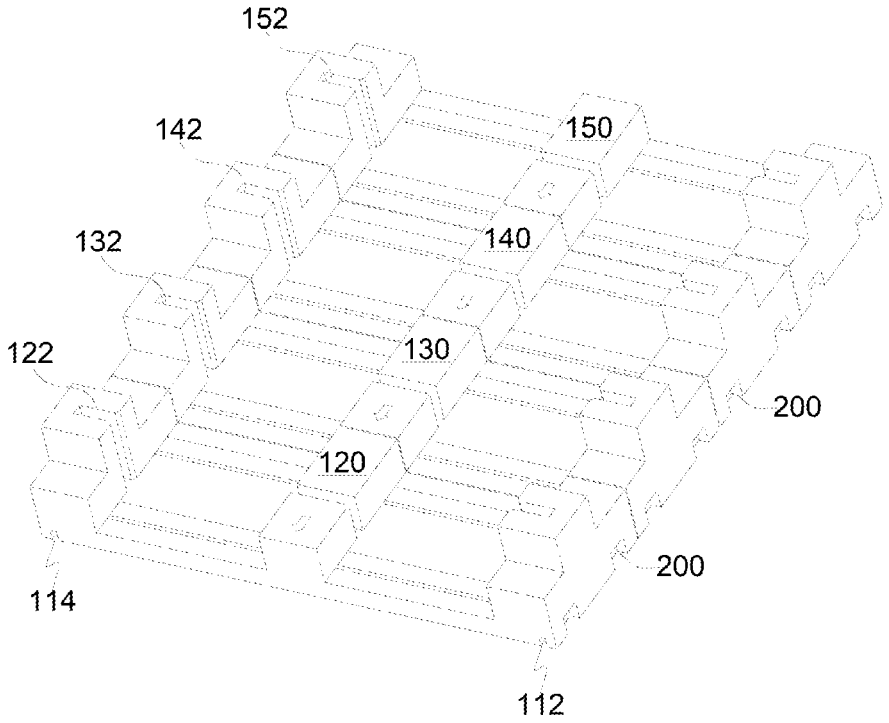
FIG. 3 is another schematic perspective view of the packaging apparatus in FIG. 1.

The first embodiment of the present invention will be described now with reference to FIG. 1 through FIG. 5. The packaging apparatus of the present invention can be used for both LCD modules and end-products such as TV, display devices. As shown in FIG. 1 through FIG. 3, the packaging apparatus for LCD modules comprises multiple packaging elements, i.e. packaging element 120; packaging element 130; packaging element 140 and packaging element 150. The packaging element 120, the packaging element 130, the packaging element 140 and the packaging element 150 have the same configuration. Each packaging element comprises a slot for receiving a LCD module. In particular, as shown in FIG. 3, the packaging element 120 comprises a slot 122 for receiving a LCD module; the packaging element 130 comprises a slot 132 for receiving a LCD module; the packaging element 140 comprises a slot 142 for receiving a LCD module; the packaging element 150 comprises a slot 152 for receiving a LCD module. The slot 122, slot 132, slot 142, slot 152 are adapted to hold and fix the edge of the LCD modules.

Figure 4:
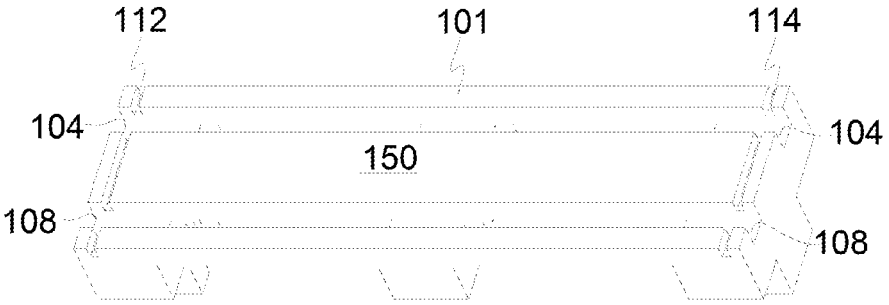
FIG. 4 is schematic perspective view of the packaging element of packaging apparatus in FIG. 1.

As shown in FIG. 1 and FIG. 2, the packaging apparatus for LCD modules further comprises a connecting means 160 for integrating the multiple packaging elements, i.e. packaging element 120; packaging element 130; packaging element 140 and packaging element 150 side by side together as a whole. The connecting means comprises at least one connecting plate; each packaging element is provided with at least one groove engaging with said at least one connecting plate. In the first embodiment, the connecting means comprises two connecting plates 200. Correspondingly, each packaging element is provided with two grooves, said two connecting plates are inserted in said two grooves respectively. Referring to FIG. 4, the packaging element 150 is provided with two grooves 112, 114 at the bottom. The grooves provided at the bottom of the packaging elements are aligned with each other so as to form an elongated channel along the integrating direction. In one embodiment of the present embodiment, each connecting plate is inserted into corresponding groove by interference fit.

Figure 5:
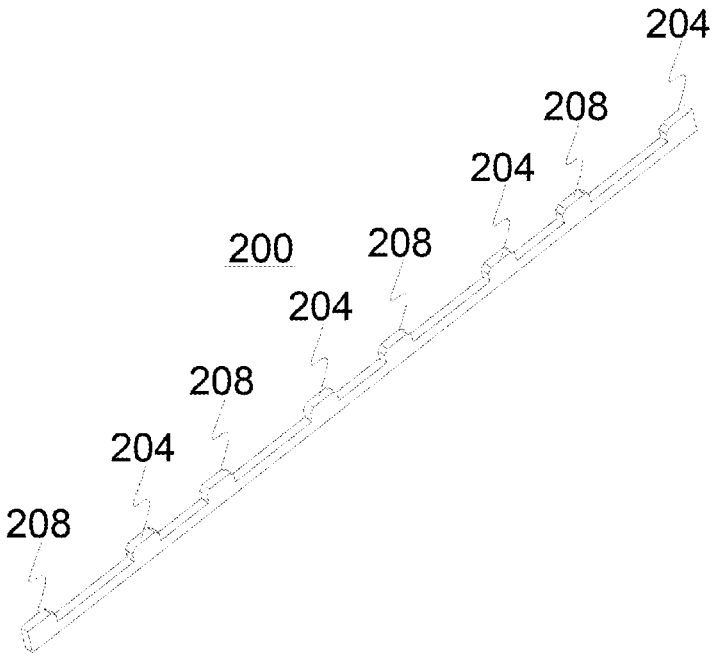
FIG. 5 is schematic perspective view of the connecting means of packaging apparatus in FIG. 1.

Since the packaging element 120, the packaging element 130, the packaging element 140 and the packaging element 150 have the same configuration; only the packaging element 150 will be described below. As shown in FIG. 4, the bottom of the packaging element 150 can be seen clearly. The packaging element 150 comprises a main body 101, grooves 112, 114. The groove 112 and the groove 114 have the same shape. As shown in FIG. 5, the connecting plate 200 is provided with multiple protrusions. The multiple protrusions comprise four first protrusions 204 and four second protrusions 208. Correspondingly, the groove 112 is provided with multiple recesses engaging with said multiple protrusions. Wherein, multiple recesses comprise four first recesses 104 and four second recesses 108. The first protrusions 204 are engaged with the first recesses 104; and the second protrusions 208 are engaged with the second recesses 108. The first protrusions 204 and the second protrusions 208 may have different heights. In this way, the packaging element 120, the packaging element 130, the packaging element 140 and the packaging element 150 can be assembled together as a whole, and the whole is not easy to separate form each other unexpectedly.

In the present embodiment, the multiple packaging elements are buffering blocks made of foamed plastic or EPE (Polyethylene foamed sheet) foam. In this way, the manufacturers of LCD modules can package individual LCD module by separate packaging element in a one-to-one mode. In use, the separate packaging element can be put at the bottom of a packing case as the bottom buffering structure, and then the edge of a LCD module is inserted in to the groove of the packaging element.

In the present invention, the connecting plate may be corrugated cardboard or PP (polypropylene) plastic hollow board. Corrugated cardboard and PP plastic hollow board are cheap and rigid enough.

Figure 6:
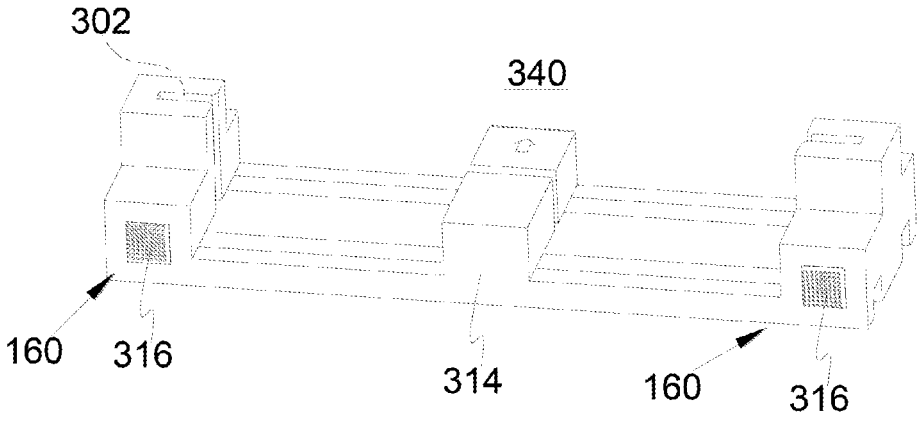
FIG. 6 is a schematic perspective view of the packaging element of the packaging apparatus according to the second embodiment of the present invention.
Figure 7:
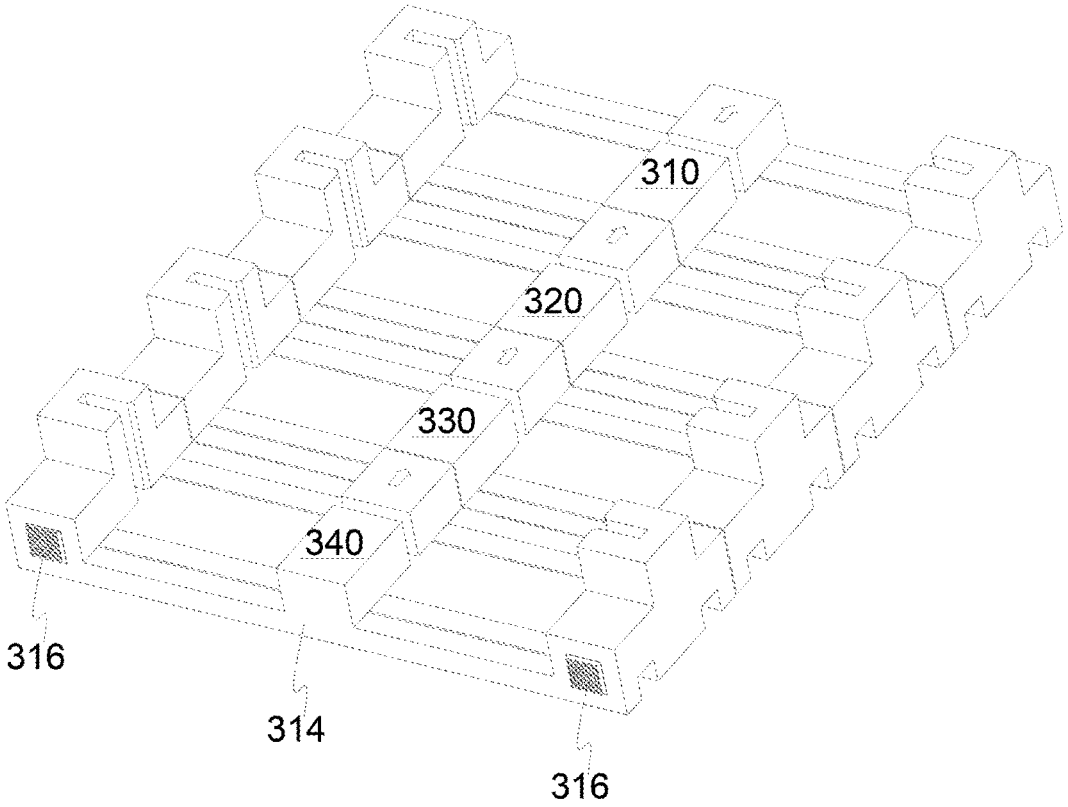
FIG. 7 is a schematic perspective view of the packaging apparatus according to the second embodiment of the present invention, which shows that four packaging elements are combined together side by side by two connecting means (hook-and-loop fastening tapes) as a detachable whole.

The second embodiment of the present invention will be described now with reference to FIG. 6 and FIG. 7. The connecting means comprises adhesive components 316 provided at the side of each packaging element. The multiple packaging elements (i.e. the packaging element 310, the packaging element 320, the packaging element 330 and the packaging element 340) are connected together side by side by the adhesive components 316. Since the packaging element 310, the packaging element 320, the packaging element 330 and the packaging element 340 have the same configuration; only the packaging element 340 will be described below. As the same with the packaging element 120, the packaging element 340 comprises a slot 302 for receiving a LCD module. In the embodiment, the adhesive components 316 are hook-and-loop fastening tapes. Compared with the first embodiment, there is no need to form a groove at the bottom of the packaging element in the second embodiment. In this way, the manufacturers of LCD modules can combine multiple packaging elements by the adhesive components 316 and package multiple LCD modules at the same time. The manufacturers of end-product (TV) can disconnect multiple packaging elements into separate packaging elements, and then separate packaging elements are used to package the end-product separately (one-to-one). In this embodiment, the adhesive components 316 consist of two layers: a "hook" side, which is a piece of fabric covered with tiny hooks, and a "loop" side, which is covered with even smaller and "hairier" loops. When the two sides are pressed together, the hooks catch in the loops and hold the pieces together. When the layers are separated, the strips make a characteristic "ripping" sound.

The packaging apparatus according to the present invention is described above by means of embodiments. However, the connecting means is not limited to the forms in first and second embodiments. For example, the connecting means can be convex-concave structures provided on the side of the packaging elements. Also, the packaging apparatus according to the present invention may be applied to other field such as sheet-like products other than LCD modules.

While the present invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

What is claimed is:

1. A packaging apparatus for LCD module, comprising multiple packaging elements, wherein each packaging element comprises a slot for receiving a LCD module, the packaging apparatus for LCD modules further comprises a connecting means for integrating the multiple packaging elements side by side, wherein the connecting means comprises at least one connecting plate; each packaging element is provided with at least one groove engaging with said at least one connecting plate, wherein said at least one groove is provided at the bottom of each packaging element, each connecting plate is inserted into corresponding groove by interference fit, wherein the connecting means comprises two connecting plates; each packaging element is provided with two grooves said two connecting plates are inserted in said two grooves respectively, wherein said at least one connecting plate is provided with multiple protrusions, said at least one groove is provided with multiple recesses engaging with said multiple protrusions.

2. The packaging apparatus of claim 1, wherein the packaging apparatus for LCD modules comprises four packaging elements.

3. The packaging apparatus of claim 1, wherein said at least one connecting plate is corrugated cardboard.

4. The packaging apparatus of claim 1, wherein said at least one connecting plate is polypropylene plastic hollow board.

5. The packaging apparatus of claim 1, wherein the multiple packaging elements are buffering blocks made of foamed plastic.

6. The packaging apparatus of claim 1, wherein the multiple packaging elements are buffering blocks made of polyethylene foamed sheet foam.

* * * * *